United States Patent [19]

Deckys

[11] 4,302,897

[45] Dec. 1, 1981

[54] MODULAR DISPLAY SYSTEM

[76] Inventor: Jonas E. Deckys, 9705 NE. 120th Pl., Kirkland, Wash. 98033

[21] Appl. No.: 128,309

[22] Filed: Mar. 7, 1980

[51] Int. Cl.[3] ..... G09F 7/00

[52] U.S. Cl. ..... 40/605; 40/539

[58] Field of Search ..... 40/124.1, 605, 539; 46/24, 25

[56] References Cited

U.S. PATENT DOCUMENTS

| | | | |
|---|---|---|---|
| 3,267,597 | 8/1966 | Jannes | 40/124.1 |
| 3,303,604 | 2/1967 | Mote | 46/25 |
| 3,720,015 | 3/1973 | Veken | 46/25 |

FOREIGN PATENT DOCUMENTS

| | | | |
|---|---|---|---|
| 642020 | 5/1928 | France | 46/24 |
| 1305201 | 1/1973 | United Kingdom | 40/124.1 |

*Primary Examiner*—Gene Mancene

*Assistant Examiner*—Wenceslao J. Contreras

[57] ABSTRACT

Reusable modular display units constructed from corrugated board are disclosed, the units transportable in knock down form. The units can be assembled and interlocked together to form a modular display for advertising products and services. The units are preferably of trapezoidal design and interlock with units of similar design and construction in side-by-side, end-to-end or side-to-end relation.

7 Claims, 20 Drawing Figures

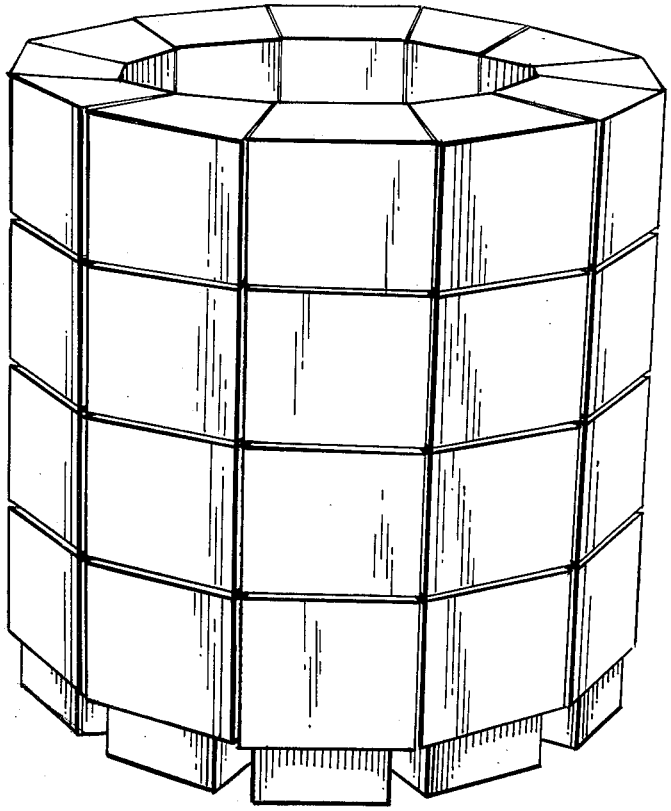
FIG. 1
FIG. 2
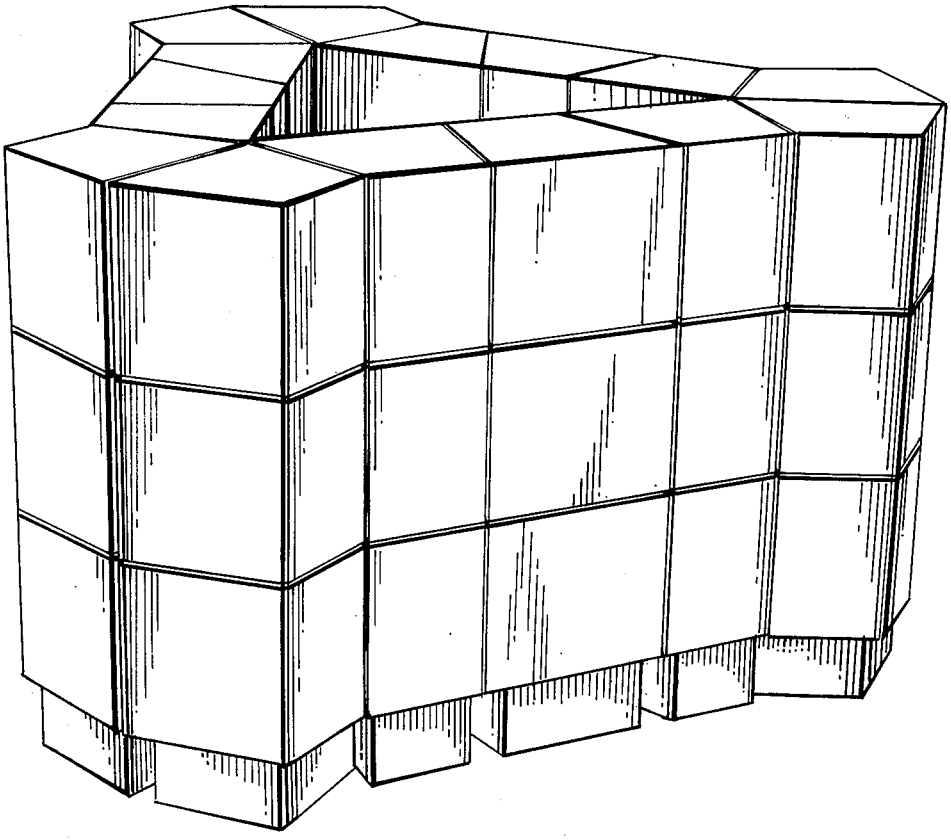

FIG. 8
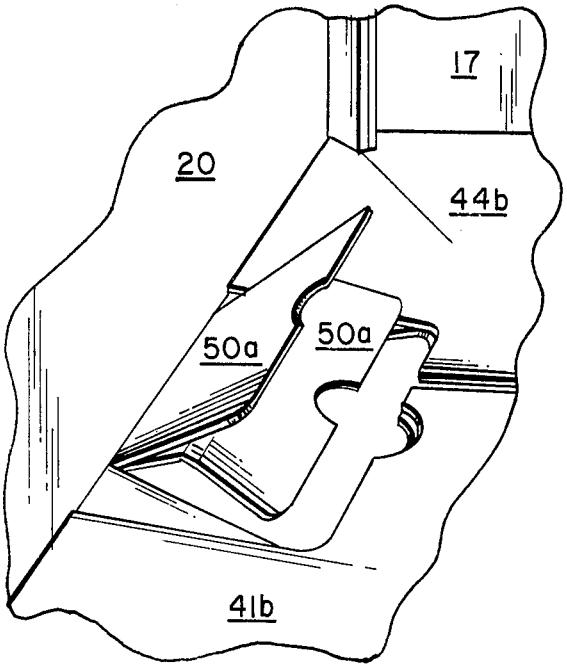
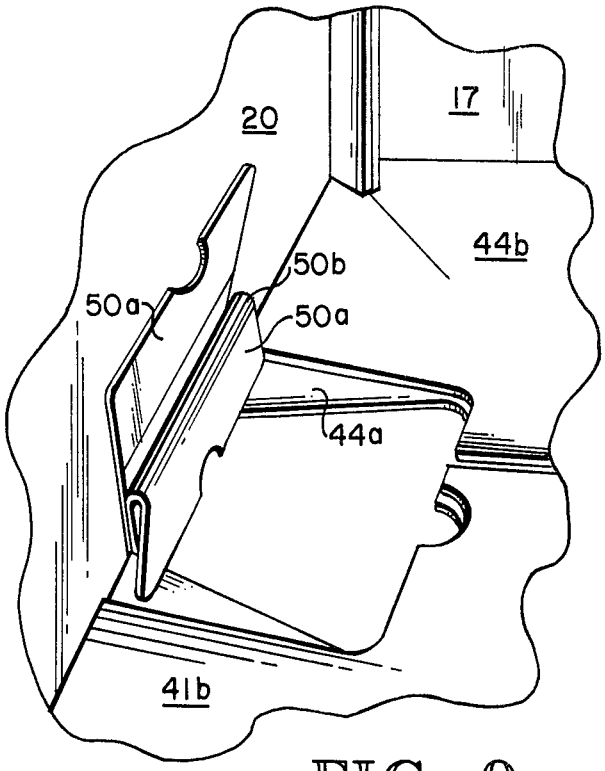
FIG. 9
FIG. 10
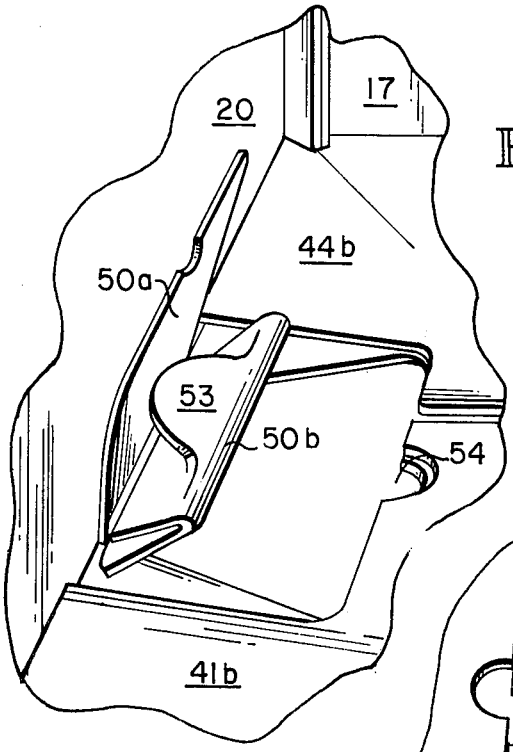
FIG. 11
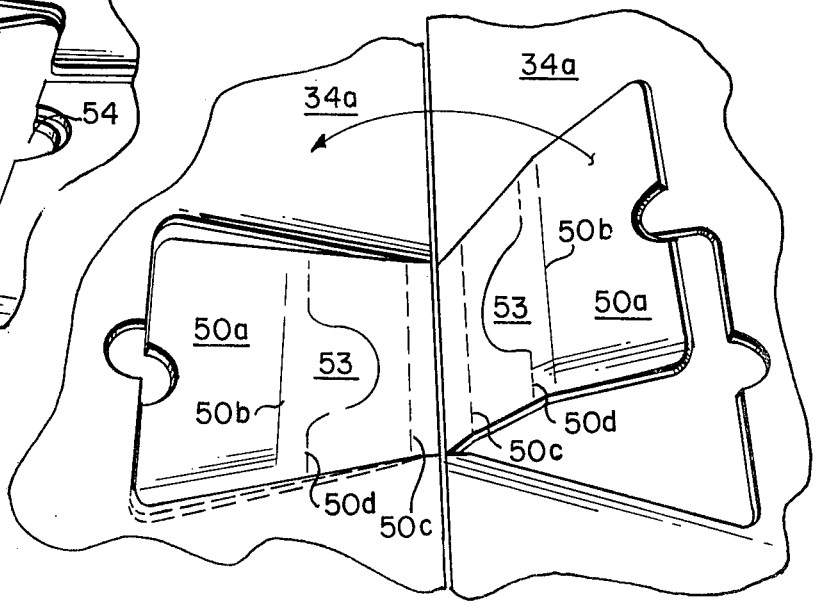

MODULAR DISPLAY SYSTEM

BACKGROUND OF THE INVENTION

Field of the Invention

This invention relates to a knock-down reusable modular three-dimensional display unit and a reusable modular display system incorporating a plurality of interlocked units.

ART RELATING TO THE DISCLOSURE

Many modular display system are available today; however, most of these sytems are either are not reusable or are limited to one design.

SUMMARY OF THE INVENTION

A primary object of this invention is to provide a knock-down reusable modular display unit which can be quickly and easily interlocked together in side-by-side, end-to-end or side-to-end relation with similar units to form a modular display system for advertising products and services.

It is a further object of this invention to provide knock down three dimensional modular display units of trapezoidal shape whose side walls are at an angle with respect to parallel end walls such that when the anguled side walls of a plurality of units are joined together in side-by-side relation with the respective parallel side walls of each unit facing the same direction, a circle is formed.

It is a further object of this invention to provide knock-down three dimensional modular display units which have a trapezoidal shape whose side walls are at an angle with respect to parallel side walls such that when the angled side walls of a plurality of such units are joined together in side-by-side relation with the respective parallel side walls of each unit alternately facing different directions, a straight line of such interlocked units is formed.

It is a further object of this invention to provide a modular three dimensional display system employing base unit pedestals of different dimensions than the display modules, the base units incorporating tab-fold interlocks which interlock with the larger display modules.

It is a further object of this invention to provide a display system constructed from modular units of corrugated board, the units assemblable in a myriad number of ways to form an aesthetic and attractive advertising display.

These and other object are accomplished by providing a three-dimensional modular display unit which can be interlocked with other like display units and which can be transported in flattened form and readily assembled at the use site. Each modular unit is comprised of a linear strip of sheet material of greater length than width having fold lines extending the width thereof and dividing the sheet into four panels with the end panels having flaps thereon for joining the respective ends of the linear strip together. Ends flaps extend from each of the ends of the panels, the end flaps including means for interlocking the flaps together to form respective end walls of the unit. Tabs are formed on each of the end flaps each tab bending along the fold lines joining the end flap to the respective panel. The tabs are adapted to interlock with tabs of an adjacent modular unit in side-by-side, end-to-end or side-to-end relation to form a three-dimensional display system. Preferably the modular units, when assembled, are of trapezoidal configuration having parallel end walls and two parallel side walls of unequal length joining non-parallel walls of equal length.

BRIEF DESCRIPTION OF THE DRAWINGS

FIG. 1 is a perspective view of a three-dimensional display in a form of a circle, the display incorporating multiple interlocking modular unit of this invention.

FIG. 2 is a perspective view of an alternative design utilizing the same interlocking modular units as in FIG. 1.

FIGS. 8, 9 and 10 are perspective views of the interlocking tabs of adjacent modular units illustrating the steps involved in interlocking the modular unit of FIG. 7 in end-to-end relation with a like modular unit;

FIGS. 11, 12, 13 and 14 are perspective views of the steps of interlocking a modular unit such as illustrated in FIG. 7 in side-to-side relation with a like modular unit;

DESCRIPTION OF THE PREFERRED EMBODIMENTS

The display system illustrated makes use of trapezoidal shaped modules; however, similar interlocking modules can be made in cubical or other shape. When a trapezoidal shape is used, the angular side walls are preferably at an angle, with respect to the parallel side walls of about 15 degrees so that the units can be interlocked as illustrated in FIG. 1 to form a circle or interlocked as illustrated in FIG. 2 to form a linear display system. The modular units are preferably made from corrugated board; however, other sheet materials may be used. The modular display units, when assembled, have one or more surfaces available to highlight photographs, artwork, graphics, etc. for advertising services, products, etc.

Figure 7:
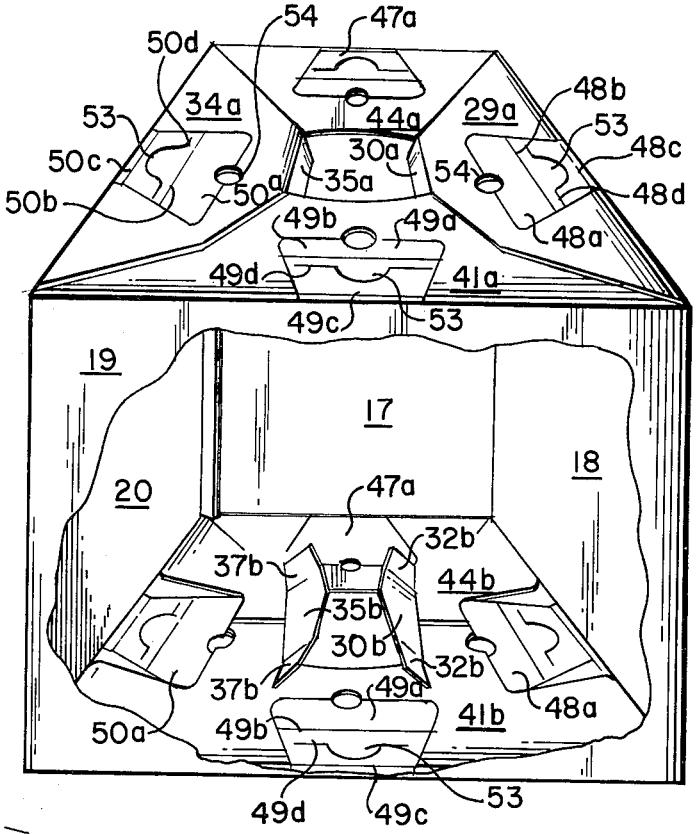
FIG. 7 is a perspective view of the assembled module of FIG. 6.
Figure 20:
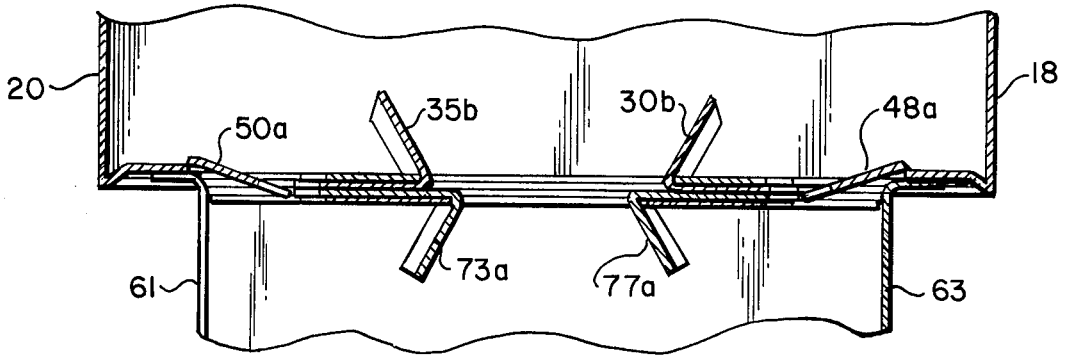
FIG. 20 is a vertical cross section along section line 20—20 of FIG. 19 illustrating the interlocking tab connecting the base unit with the display unit.

FIG. 1 illustrates a display system made by joining the modular unit of FIG. 7 in side-by-side and end-to-end relation to form a complete circle, the display units supported on modulaase unit of smaller dimensions as illustrated by FIG. 20. FIG. 2 illustrates assembly of the same modules as FIG. 1 but in a different pattern to form a different display system. The modular units can be joined together in numerous ways to form display systems of varying size and design.

Figure 3:
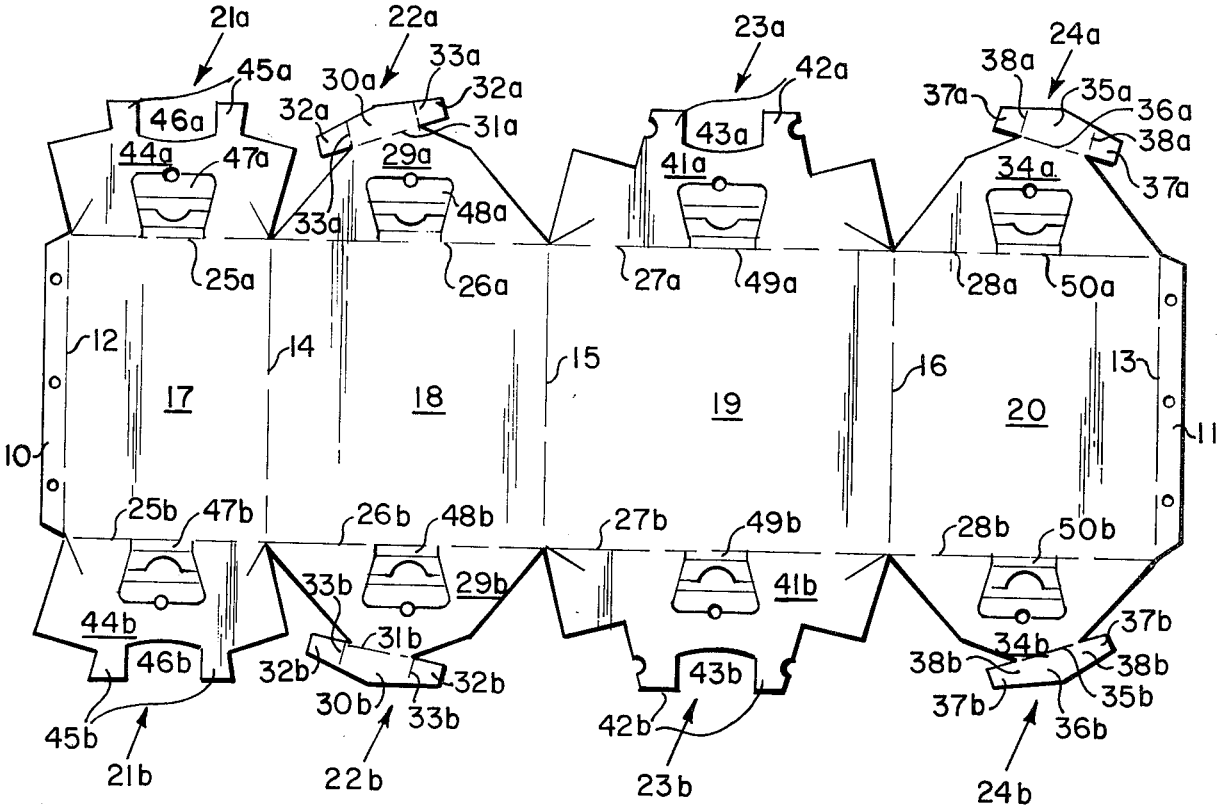
FIG. 3 is a plan view of the flattened pattern of a modular display unit of this invention.
Figure 4:
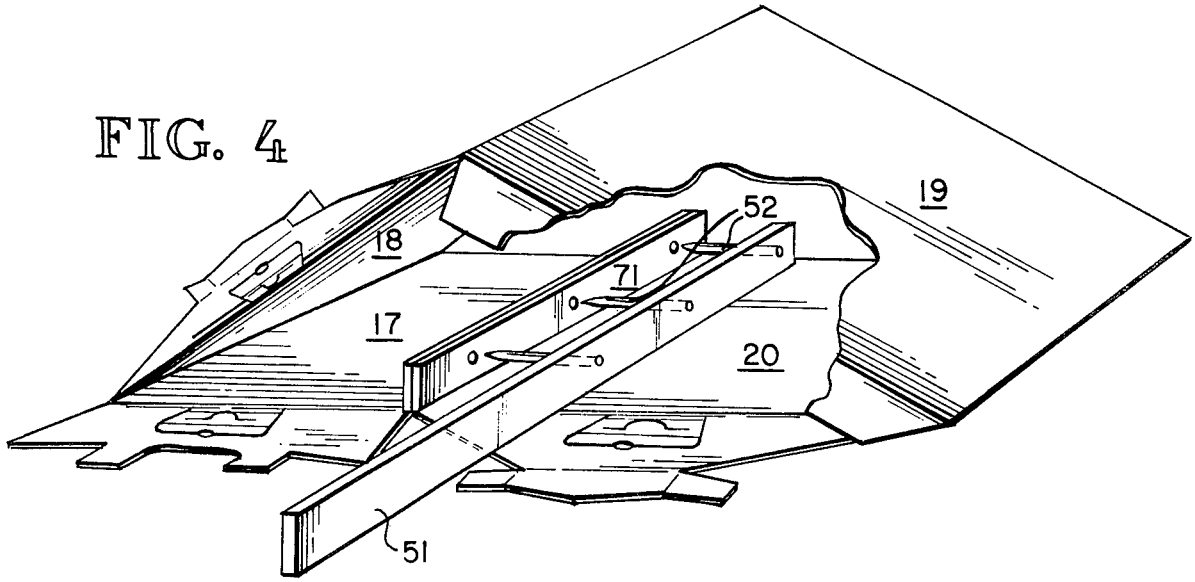
FIG. 4 is a perspective view of a jig used in bonding the end tabs of the pattern of FIG. 3 together.

Referring to FIG. 3, a flattened pattern of the modular unit of FIG. 7 is shown, the pattern consisting of a linear strip of sheet material, such as corrugated board of greater length than width having end tabs 10 and 11 connected to the main body of the flattened pattern by fold lines 12 and 13. Fold lines 14, 15, and 16, extending the width of the sheet material, divide the sheet material into panels 17, 18, 19 and 20. Panels 18 and 20 are of equal size. Panel 17 is smaller than panel 19 and panel 19 is larger than either panels 18 or 20. The flattened sheet material is folded along fold lines 12, 13, 14, 15, and 16, joined and adhesively bonded together by end flaps 10 and 11 as illustrated in FIG. 4. Associated with each of the panels 17, 18, 19 and 20 are end flaps 21*a*, 21*b*, 22*a*, 22*b*, 23*a*, 23*b*, 24*a* and 24*b*. The respective end flaps are connected to the main body of the sheet material along fold lines 25*a*, 25*b*, 26*a*, 26*b*, 27*a*, 27*b*, 28*a* and 28*b*. The end flaps are designed to interlock with each other to form the end walls of the unit as illustrated in FIG. 7. End flaps 22*a* and 22*b* include main body portions 29*a* and 29*b* having terminating edges angling from their connection to the panel 18 terminating in tabs 30*a* and 30*b* joined to the main body potions 29*a* and 29*b* by fold lines 31*a* and 31*b*. The ends 32*a* and 32*b* of tabs 30*a* and 30*b*, respectively, are joined to the main tab bodies by fold lines 33*a* and 33*b*.

Similarly, end flaps 24*a* and 24*b* include main body portions 34*a* and 34*b* joined to panel 20 by fold lines 28*a* and 28*b* and include, on their respective ends, tabs 36*a* and 36*b* whose end portions 37*a* and 37*b* are joined to the tabs by fold lines 38*a* and 38*b*.

End flaps 21*a* and 21*b* include main body portion 44*a* and 44*b* whose terminating side edges diverge outwardly from their connection to panel 17 as illustrated. The end edges of flaps 44*a* and 44*b* terminate in tabs 45*a* and 45*b* having slots 46*a* and 46*b* therebetween. Similarly, end flaps 23*a* and 23*b*, joined to panel 19 by fold lines 27*a* and 27*b*, include main body portions 41*a* and 41*b* which include tabs 42*a*, 42*b* on the respective terminating end edges having slots 43*a* and 43*b* therebetween.

To assemble the flattened sheet material of FIG. 3 to form a modular unit as illustrated in FIG. 7, the end flaps 10 and 11 are adhesively bonded together as illustrated in FIG. 4. A jig 51 having spikes 52 used to align the end tabs may be used, if desired.

Figure 6:
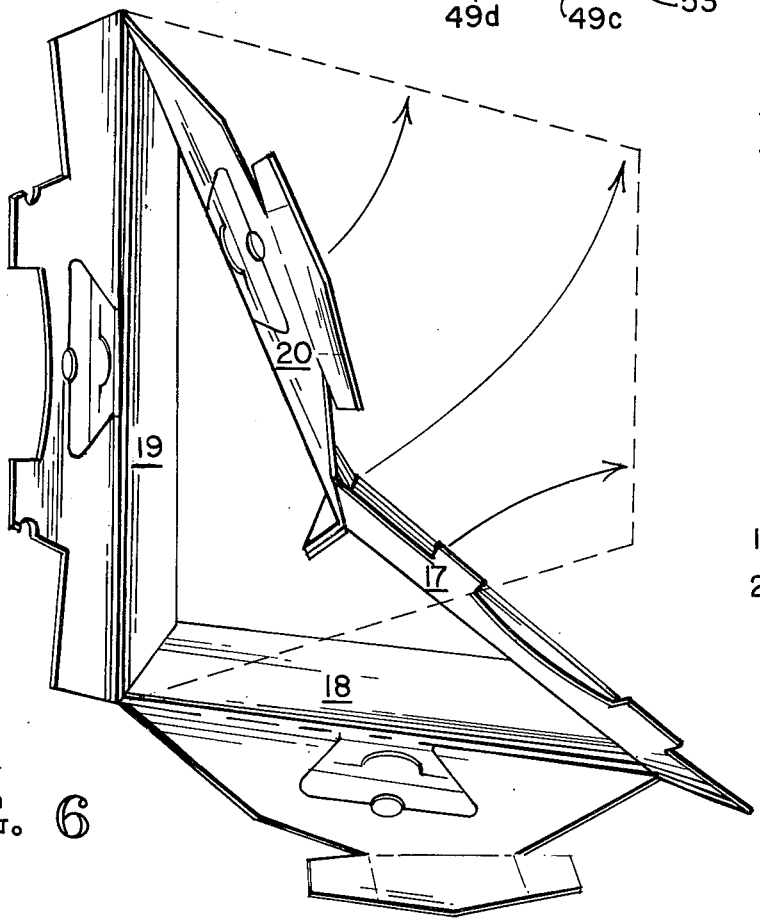
FIG. 6 is a perspective view of the modular unit in FIG. 3 being opened for assembly.
Figure 5:
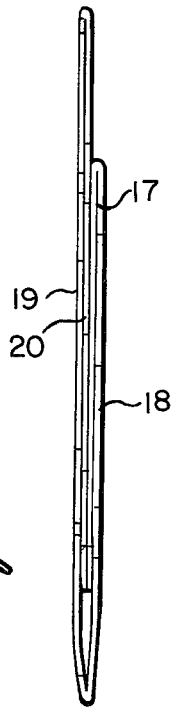
FIG. 5 is an end view of the modular unit of FIG. 4 folded and flattened for transport.
Figure 12:
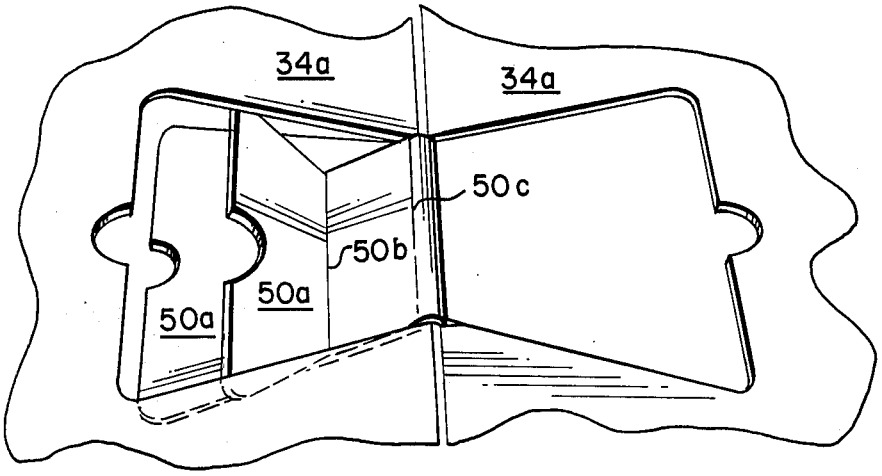
Figure 13:
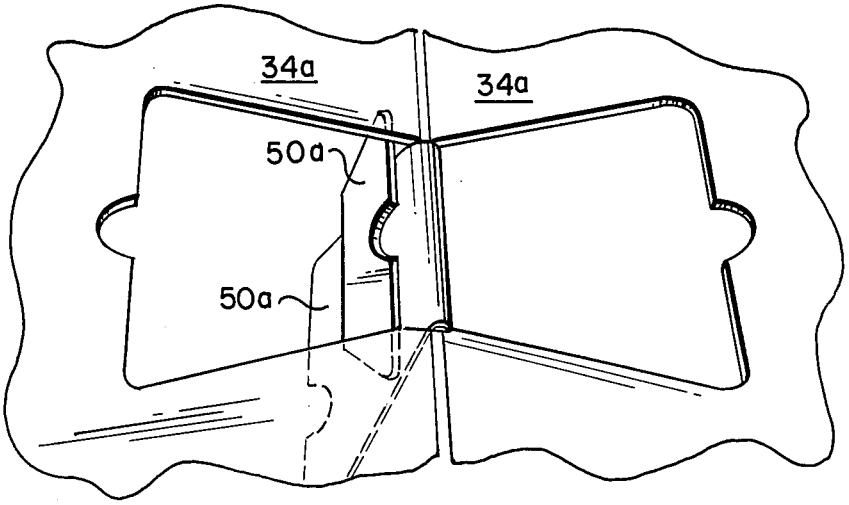
Figure 14:
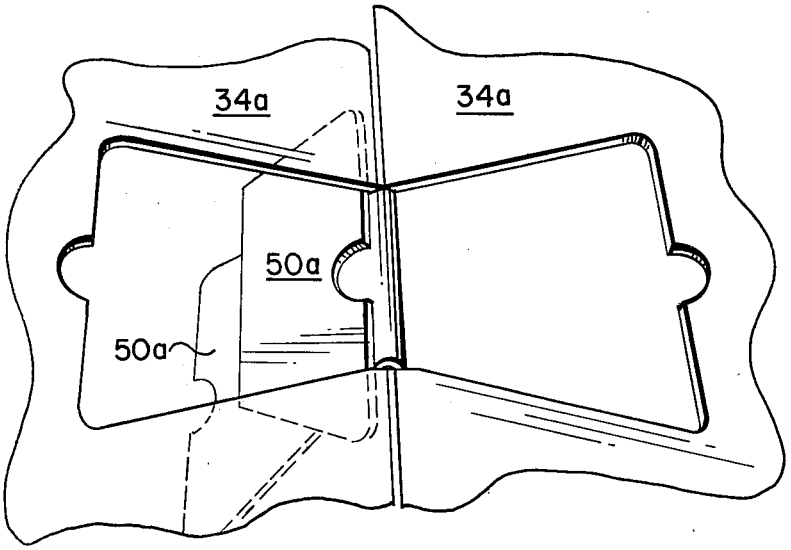

As illustrated by FIGS. 5 and 6, the modular unit may be folded for packing and transporting as illustrated in FIG. 6. When ready to be assembled, the unit is unfolded in the manner illustrated in FIG. 6. The respective end flaps of the unit are interlocked together as illustrated in FIG. 7. Referring to FIG. 7, end flaps 23*a* and 23*b* are folded along fold lines 27*a* and 27*b* and end flaps 21*a* and 21*b* are folded along fold lines 25*a* and 25*b*. Then the respective end flaps 22*a* and 22*b* and 24*a* and 24*b* are folded as illustrated with the tabs 30*a*, 30*b*, 35*a*, and 35*b* extending through the central opening formed by the slots 46*a* and 46*b*. The ends 37*a*, 37*b*, 32*a* and 32*b* of the tabs 30*a*, 30*b*, 35*a* and 35*b* hold the end panels together as illustrated in FIG. 7.

Modular units assembled as illustrated in FIG. 7 maybe joined together in end-to-end, side-by-side, or side-to-end relation by interlocking tabs. Referring again to FIG. 3, each of the end flaps includes an interlocking tab, all of similar design. For example, end flap 21*a* includes tabs 47*a* and 47*a*′ which bend along fold lines 25*a* and 25*b*. Similarly, end flaps 22*a*, 22*b*, 23*a*, 23*b*, 24*a* and 24*b* include interlocking tabs 48*a*, 48*a*′, 49*a*′, 50*a* and 50*a*′ all of similar design. Each of the tabs 47, 48, 49 and 50 includes a fold line 47*b*, 48*b*, 49*b* and 50*b* midway of the length of the tab and a similar fold line 47*c*, and 50*c* about the thickness of the corrugated board from respective fold lines 25, 26, 27 and 28. A cut out portion 47*c*, 48*c*, 49*c* and 50*c* joined by fold lines 47*d*, 48*d*, 49*d* and 50*d* is located intermediate the mid-fold line and the fold line joining the end flap to the respective panel 17–20.

FIGS. 8–10 illustrate how the tabs of one modular unit is used to interlock in end-to-end relation with an adjacent modular unit. Referring to FIG. 8, two modular units of the type illustrated in FIG. 7 are stacked in end-to-end relation. The tab 50*a*, located on the upper end wall of the lower modular unit meshes with tab 50*a*′ located on the bottom end wall of the upper modular unit. Tab 50*a*′ is pulled upwardly as illustrated in FIG. 8 to allow tab 50*a* to be folded along fold line 50*b* as illustrated in FIG. 9 and to allow tab 53 to press against the lower side of tab 50*a*′ as illustrated in FIG. 10 to hold the two units together. The same process is repeated for the other tabs 47, 48, and 49 to firmly interlock the modular units together.

The units may also be joined together in end-to-side relation as illustrated in FIGS. 11 to 14. When units are joined together in both end-to-end and side-by-side relation two tabs may be used to join adjacent side-by-side units and two other tabs used to join the units in end-to-end relation.

Figure 15:
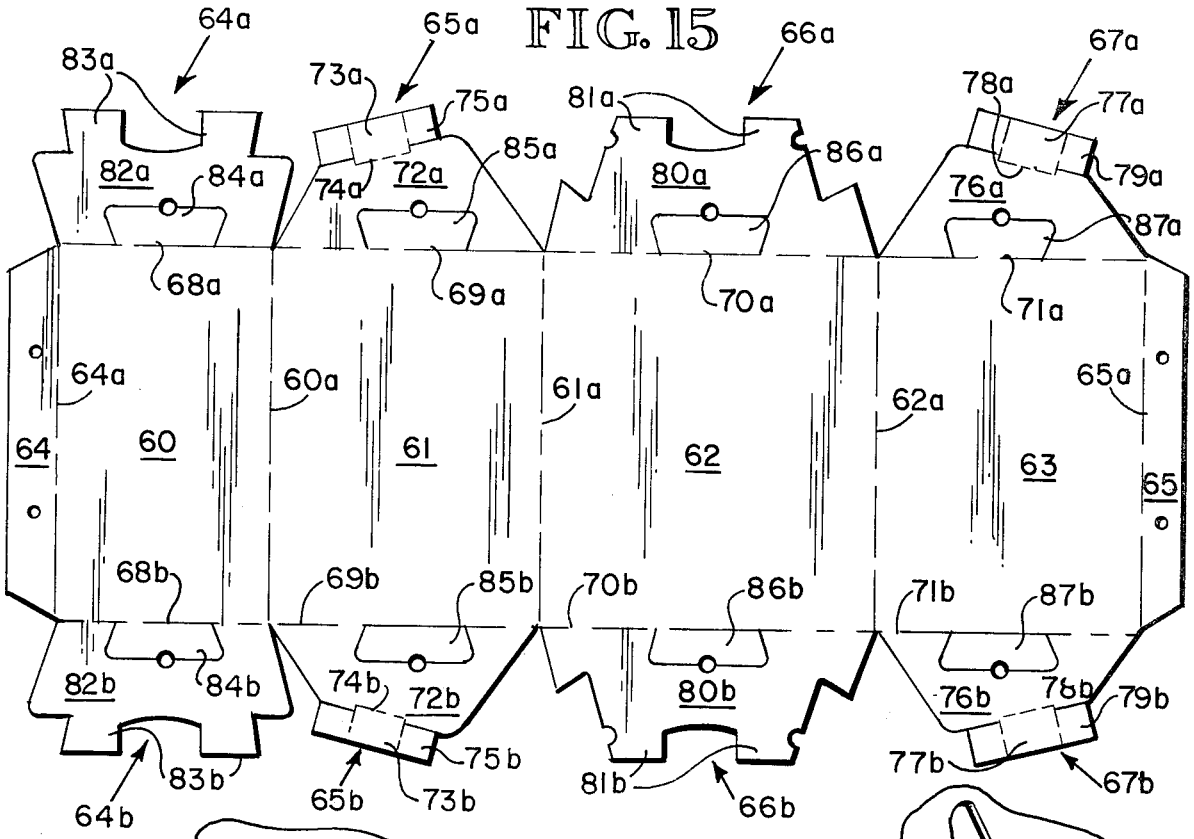
FIG. 15 is a plan view of a flattened pattern of the modular base unit of this invention.

FIG. 15 illustrates the flattened pattern of a base pedestal. The base, when assembled, resembles the unit of FIG. 7 except that it is of smaller dimensions and the interlocking tabs are approximately half the size of those of the modular units of FIG. 7. The base unit is made from linear strips of sheet material of greater length than width divided into panels 60, 61, 62 and 63 by fold lines 60*a*, 61*a* and 62*a*. End flaps 64 and 65, connected to panels 60 and 63, respectively, by fold lines 64*a* and 65*a*, are used to adhesively bond the end panels together in a similar manner as described with regard to the modular unit of FIG. 7 and as illustrated in FIG. 4. Panels 61 and 63 are of equal dimension. Panel 62 is of larger dimensions than panels 61 and 63 and panel 60 is of smaller dimension than either panels 61, 62 or 63. Each of the panels has associated with it respective end flaps 64*a*, 64*b*, 65*a*, 65*b*, 66*a*, 66*b*, 67*a* and 67*b*. The respective end flaps are joined to the panels 60–63 along fold lines 68*a*, 68*b*, 69*a*, 69*b*, 70*a*, 70*b*, 71*a* and 71*b*. Each of the end flaps includes a main body portion 72*a*, 72*b*, 76*a*, 76*b*, 80*a*, 80*b*, 82*a* and 82*b*. End flaps 72*a* and 72*b* include tabs 73*a* and 73*b* having end portions 75*a* and 75*b* joined to the main body of the tab by fold lines 74*a* and 74*b*. In a similar manner, end flaps 76*a* and 76*b* include integral tabs 77*a* and 77*b* joined to the end flap along fold lines 78*a* and 78*b*. The tabs also include end portions 79*a* and 79*b*. End flaps 80*a* and 80*b* formed as illustrated include extending tab portions 81*a* and 81*b* having a slot therebetween. Similarly, end flaps 82*a* and 82*b* include tab portions 83*a* and 83*b* having a slot therebetween. The base unit is assembled in a similar manner as described with regard to FIG. 7, with the tabs 77*a*, 77*b*, 73*a* and 73*b* interlocking to hold the end flaps together.

Each of the end flaps also includes interlocking tabs 84*a*, 84*b*, 85*a*, 85*b*, 86*a*, 86*b*, 87*a* and 87*b* of the same width but half the length of the tabs 47*a*, 47*b*, 48*a*, 48*b*, 49*a*, 49*b*, 50*a* and 50*b* of the unit of FIG. 3. The interlocking tabs are joined to panels 60, 61, 62 and 63 along respective fold lines 68, 69, 70 and 71.

Figure 16:
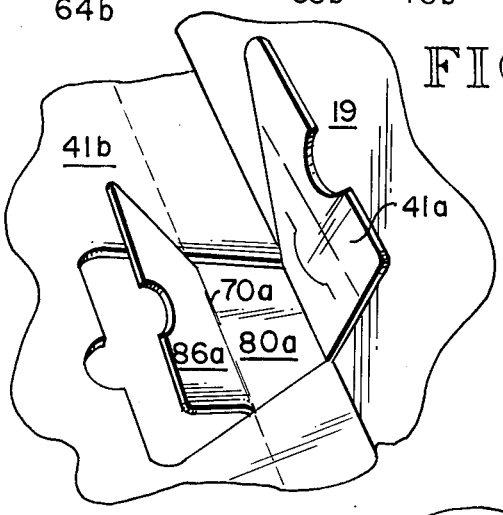
FIGS. 16, 17 and 18 are perspective views of the steps of interlocking in end-to-end relation, the base unit formed by assembling FIG. 15 with the modular display unit of FIG. 5.
Figure 17:
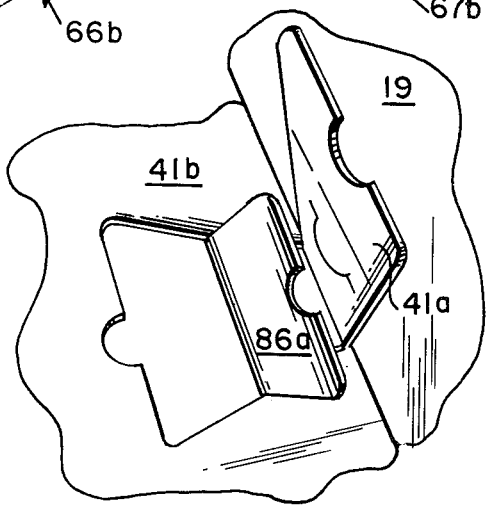
Figure 18:
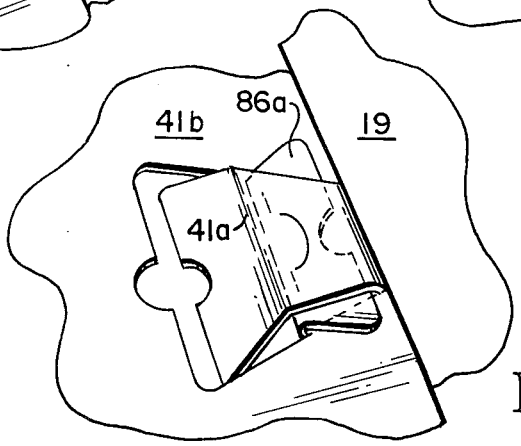
Figure 19:
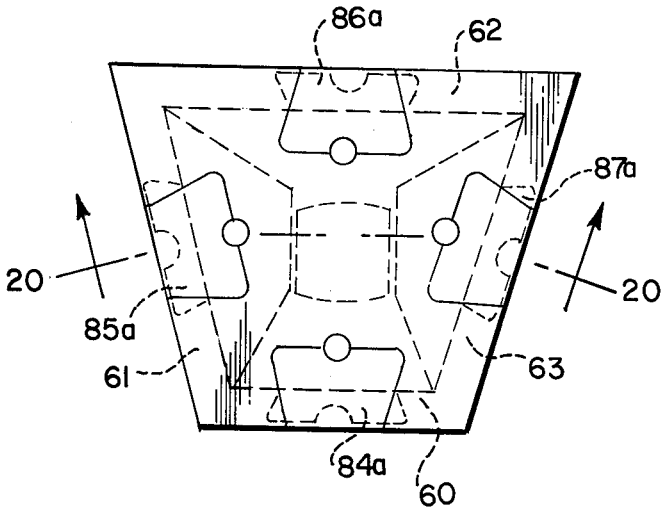
FIG. 19 is a top view of a modular display unit interlocked with a modular base unit.

FIGS. 16, 17 and 18 illustrate the manner of joining the base unit of FIG. 15 to the display unit of FIG. 7. As illustrated in FIG. 16, an assembled display unit is placed atop an assembled base unit with the interlocking tabs aligned. Tab 86*a* is folded along fold line 70*a* as illustrated and the tab in the upper modular unit 41*a'* is pushed down into the opening created by folding tab 86*a* back on itself to lock tab 86*a* in place and hold the two units together. In a similar manner, the other tabs may be locked to hold the base unit firmly to the display unit. This is clearly shown in FIGS. 19 and 20, which illustrates interlocking of the base unit with the modular display unit.

The modular display units described can be used in endless ways to form display systems of varying shapes and designs. They can be quickly assembled or disassembled for transportation to a different site. The display system can be changed to form different designs without requiring different modular units.

I claim:

1. A knock-down modular three-dimensional display unit which can be transported in flattened form and readily assembled at the use site, comprising:

a linear strip of sheet material of greater length than width having fold lines extending the width thereof and dividing the sheet into four panels with the end panels having terminating flaps thereon for joining the respective end panels of the linear sheet material together to form an enclosed module;

end flaps extending from each of the ends of the respective panels and joined to the respective panels by fold lines, the end flaps including means for interlocking the end flaps together to form end walls of the unit; and tabs formed within each of the end flaps, each tab bending along the fold line joining the end flap to its respective panel, the tabs having a width along the fold line less than the width of the tab at its upper end, the tabs adapted to interlock with tabs of an adjacent modular unit in side-by-side, end-to-end or side-to-end relation to form a three-dimensional display system, the unit, when assembled, having parallel end walls so that the units can be stacked atop one another to form a display system.

2. The modular unit of claim 1, wherein the strip of sheet material is divided into four panels, two of which are of equal length and two of which are of unequal length so that when the sheet material is folded together with the end flaps thereon adhesively joined together, a trapezoid is formed having two parallel walls of unequal length adjoining non-parallel walls of equal length.

3. The display unit of claim 2, wherein the angle of the side walls with respect to the parallel walls is about 75°.

4. The unit of claim 1, wherein each tab is divided by a fold line intermediate its ends, the fold line extending lengthwise so that the tab can be folded back on itself.

5. A knock-down modular three-dimensional display system employing multiple trapezoidal units, each unit capable of being flattened for transportation and readily assembled at the use site, each unit comprising in knock-down form:

a linear piece of sheet material of greater length than width having fold lines extending the width dimension thereof and dividing the sheet into first, second, third and fourth panels with the first and fourth panels including end flaps for joining the first and fourth panels together to form a trapezoid having two parallel walls of unequal length joining non-parallel walls of equal length;

end flaps extending from the respective ends of each of the panels, the end panels including means for interlocking the flaps together to form a first end wall on one end of the trapezoid unit and a second end wall on the other end of the trapezoid unit;

tabs formed within each of the end flaps, each tab bending along the fold line joining the respective end flap to its respective panel, the tabs having a width along the fold line less than the width thereof at its upper end, the tabs arranged to interlock with the tabs of an adjacent trapezoid unit of similar design and construction in side-by-side, end-to-end or side-to-end relation to form a three-dimensional display.

6. The unit of claim 5, wherein the end flaps include a first set extending laterally outwardly from the fold lines joining the respective end flaps to the first and third panels, each of the end flaps having two projecting tabs forming a slot therebetween, wherein a second set of flaps is joined to the second and fourth panels by fold lines, the second set of end flaps having side edges extending inwardly toward each other and joining respective tongues having tabs on each of their ends, the tongues joined to the end flaps along fold lines and having a length substantially equal to the side walls of the central opening formed by the overlapping projecting tabs of the first set of flaps, the tabs on each of the ends of the tongues bent beneath the end flaps and retain the end flaps and form the end wall of the modular unit.

7. The modular unit of claim 4, wherein the interlocking tabs of one unit are mated with the interlocking tabs of an adjacent unit and folded such that the tab of one unit locks and retains the tab of the adjacent unit.

* * * * *